US007677294B2

(12) United States Patent
Bohlen

(10) Patent No.: US 7,677,294 B2
(45) Date of Patent: Mar. 16, 2010

(54) END MOUNTING FOR SUPPORTING A ROLLER

(75) Inventor: Jorg Bohlen, Langen (DE)

(73) Assignee: Hunter Douglas Industries BV, El Rotterdam (NL)

( * ) Notice: Subject to any disclaimer, the term of this patent is extended or adjusted under 35 U.S.C. 154(b) by 389 days.

(21) Appl. No.: 11/615,870

(22) Filed: Dec. 22, 2006

(65) Prior Publication Data

US 2007/0158037 A1 Jul. 12, 2007

(30) Foreign Application Priority Data

Jan. 10, 2006 (EP) ..... 06250103

(51) Int. Cl.
*E06B 9/17* (2006.01)
*A47H 1/13* (2006.01)
*E36B 9/56* (2006.01)

(52) U.S. Cl. ..... 160/323.1; 160/903

(58) Field of Classification Search ..... 160/238, 160/24, 323.1, 324, 325, 326, 370.22, 393, 160/903; 242/596.4, 596.7, 597.1, 599, 599.3; 248/221.11, 222.11, 251, 252, 261, 262, 248/267, 264, 268, 266; 296/37.16; 403/108, 403/109.3, 166, 326, 329, 327
See application file for complete search history.

(56) References Cited

U.S. PATENT DOCUMENTS 3,099,916 A 8/1963 Rosenbaum
3,581,800 A * 6/1971 Nelson et al. ..... 160/323.1
4,373,569 A 2/1983 Barettella
4,538,785 A * 9/1985 Damsgaard ..... 248/268
5,083,601 A * 1/1992 Tedeschi ..... 160/323.1
5,450,891 A * 9/1995 Benthin ..... 160/323.1
5,934,354 A * 8/1999 Price et al. ..... 160/370.22
6,131,642 A * 10/2000 Welfonder ..... 160/301
6,457,688 B1 * 10/2002 Welfonder ..... 248/266
6,575,503 B1 * 6/2003 Johansson et al. ..... 292/170
7,100,668 B2 * 9/2006 Allsop ..... 160/321

FOREIGN PATENT DOCUMENTS

EP 0 046 948 A2 3/1982
EP 0 672 814 A1 9/1995
GB 588698 5/1947
GB 2 339 820 A 2/2000

* cited by examiner

*Primary Examiner*—Katherine W Mitchell
*Assistant Examiner*—Jeremy C Ramsey
(74) *Attorney, Agent, or Firm*—Dorsey & Whitney LLP

(57) ABSTRACT

An end mounting for supporting the roller of a cover for an architectural opening, the end mounting including a main body of substantially constant cross-section extending axially from a proximal end for mounting adjacent an architectural opening to a distal end for insertion into an end opening of a roller. A slider is mounted in the main body at an axial location towards the proximal end of the main body and is movable between a retracted position wholly within the cross-section of the main body and an extended position in which at least part of the slider protrudes outside the cross-section of the main body. With the slider in the retracted position, substantially all of the main body can be inserted into the end opening of the roller and, with the slider in the extended position, the main body is prevented by the slider from being inserted into the end opening of the roller beyond the slider.

14 Claims, 6 Drawing Sheets

END MOUNTING FOR SUPPORTING A ROLLER

CROSS REFERENCE TO RELATED APPLICATION

This application claims priority to European Application No. 06250103.6, filed 10 Jan. 2006, and such application is hereby incorporated by reference as if fully disclosed herein.

BACKGROUND OF THE INVENTION

1. Field of the Invention

The present invention relates to an end mounting for supporting a roller, in particular the roller of a cover for an architectural opening.

2. Description of the Relevant Art

Various blinds are known for selectively covering architectural openings. Many of these include rollers that are rotatably mounted, usually in a horizontal orientation, for instance across the top of the architectural opening. To facilitate installation of the roller, an arrangement may be provided whereby an end mounting, for instance as part of a bracket, is mounted adjacent the architectural opening for each end of the roller and then the roller is fitted between the two end mountings. The ends of the roller may be provided with axial holes for receiving support shafts which extend from the end mountings. However, it will be appreciated that, for the roller to be secured in place, the distance between the ends of the roller must be greater than the distance between the inwardly facing ends of the support shafts. This makes mounting of the roller extremely difficult. Of course, support shafts can be provided on the ends of the rollers with corresponding holes provided in the end mountings, but the same problem exists.

Previously, it has been proposed to provide some form of sprung telescoping action. In particular, the roller can be formed so as to be partly collapsible in length by means of some telescoping action, with a spring force biasing the roller to an extended length. Alternatively, support shafts in the roller or end mountings may be sprung to an extended position, but collapsible against that spring force to a retracted position. In this way, for installation, the roller or support shafts can be compressed against their resilient restoring forces to allow insertion of the roller between the end mountings. Various documents consider such arrangements, for instance GB 588,698, EP 0 046 948, EP 0 672 814, U.S. Pat. No. 3,099,916, U.S. Pat. No. 4,373,569 and GB 2 339 820.

A problem with these previous arrangements is that they rely on the spring force of the telescoping roller or end pin to ensure that the roller is held in place. In some arrangements, the axial spring force may have a negative impact on the frictional resistance to rotation of the roller. In time, also, the spring force may diminish such that there is a danger that the roller will fall from its installation. These problems become even more significant as the roller becomes larger. With larger rollers, once mounted, the operating forces can sometimes overcome the spring force of the telescoping roller or end pin with the risk that the roller drops from its mounting. Increasing the spring force hampers mounting. Furthermore, because of the need to build components that can sustain the increased force, costs will be increased and the size of the mounting may also be increased. For instance, it may be possible to provide easily a relatively small bracket for supporting the weight of a roller, but the size and strength of that bracket may need to be increased significantly in order to withstand the outward axial forces of the telescoping action.

BRIEF SUMMARY OF THE INVENTION

According to the present invention, there is provided a method of securing the roller of an architectural opening covering between two end mountings, the method including:

providing at least one end mounting with a main body of substantially constant cross-section for insertion into an end opening of one end of the roller;

mounting a slider in the main body so as to be movable between a retracted position entirely within the cross-section of the main body and an extended position in which at least part of the slider protrudes outside the cross-section of the main body;

arranging the slider in the retracted position;

positioning the one end of the roller on the at least one end mounting with the main body entirely within the end opening;

fitting the other end of the roller to the other of the two end mountings by moving the roller axially to expose the slider; and moving the slider to the extended position such that the main body is prevented by the slider from being inserted into the end opening of the roller beyond the slider so as to maintain the axial position of the roller and maintain the other end of the roller on the other end mounting.

According to the present invention, there is also provided an end mounting for supporting the roller of a cover for an architectural opening, the end mounting including:

a main body of substantially constant cross-section extending axially from a proximal end for mounting adjacent an architectural opening to a distal end for insertion into an end opening of a roller; and a slider mounted in the main body at an axial location towards the proximal end of the main body and movable between a retracted position wholly within the cross-section of the main body and an extended position in which at least part of the slider protrudes outside the cross-section of the main body such that, with the slider in the retracted position, substantially all of the main body can be inserted into the end opening of the roller and, with the slider in the extended position, the main body is prevented by the slider from being inserted into the end opening of the roller beyond the slider.

In this way, the end mounting can be used to allow a roller to be installed easily between it and another end mounting with the slider then preventing the roller from unintentionally falling from its installed state. In particular, the end mounting is preferably used such that, with an end of a roller fully encompassing the main body of the end mounting, in other words with the main body fully inserted into the end opening of the roller, the opposite end of the roller can be swung up into position adjacent an opposite end mounting and then moved axially so as to engage with that opposite end mounting. By moving the slider of the end mounting of the present invention into the extended position, the roller is prevented from moving axially back to its original position such that it is securely held in its installed state. It will be appreciated that this is achieved without the need for any large axial sprung forces.

The slider could be freely movable between the retracted and extended positions, for instance with a detent arrangement to hold it in each position. However, preferably, a bias mechanism is provided for biasing the slider from the retracted position to the extended position.

In this way, the arrangement is always in a state to hold a roller securely in place. Furthermore, when a user is installing the roller, that user does not need to access the end mounting to move the slider to its extended position whilst holding the roller in place.

Preferably, the bias mechanism includes a compression spring. The main body may include walls defining an internal cavity for housing the compression spring. The internal cavity can also receive the slider. The compression spring can be arranged to act between one of the walls and the slider so as to bias the slider from the retracted position to the extended position.

This provides a compact and effective way of moving the slider.

It is possible to use the end mounting by manually holding the slider in its retracted position against the force of the bias mechanism whilst inserting the main body into the end opening of the roller. However, preferably, a latch mechanism is provided for latching the slider in the retracted position against the bias of the bias mechanism.

In this way, the slider can be latched into its retracted position before a user attempts to install a roller. It is then easy for the user to offer up the end of the roller to the end mounting and move it onto the end mounting such that the main body is fully inserted into the end opening.

A release member may be provided to release the latch mechanism once the roller has been installed such that the slider moves to its extended position. Preferably, the release member is provided as part of the latch mechanism and is movable axially towards the proximal end from a latched position to a released position whereby, with the release member in the released position, the latch mechanism unlatches the slider.

With the release member operable in this way, in particular, in this direction, it becomes possible to use movement of the roller during installation to release the latched slider. In other words, with the main body inserted into the end opening of the roller, as the roller moves axially towards the proximal end of the main body, it can be arranged to move the release member to the released position so as to unlatch the slider. The slider, being within the end opening of the roller will be restrained from movement to its extended position. However, once the roller is then moved axially away from the proximal end of the main body such that the slider is located axially outside the end opening of the roller, the bias mechanism will automatically move the slider to its extended position so as to secure the roller in place.

Preferably, the main body includes, at the distal end, an axially facing recessed end wall defining an opening through which the release member extends.

In this way, the release member is protected from being accidentally moved when the end of the roller is offered up in the general vicinity of the end mounting.

The roller may be provided with a trigger member extending in an axial direction within its end opening and arranged to engage with the release member once the slider is at least partly within the opening such that further movement of the main body into the opening causes the trigger member to move the release member towards the proximal end of the main body and unlatch the slider. In this respect, the trigger member can be arranged in such a way that it does not move the release member when the end of the roller is offered up to the end mounting but only when the main body is inserted into the end opening and the roller is moved axially.

Preferably, the main body includes a catch for interaction with the latch mechanism. The latch mechanism can include an arm extending from the slider at a first end to a hook portion at a second end, the hook portion being arranged to engage with the catch so as to latch the slider in the retracted position.

This provides an effective and space-efficient way of latching the slider in the retracted position.

Preferably, the second end of the arm and the hook portion are movable relative to the main body so as to disengage the hook portion from the catch and unlatch the slider.

The release member may be provided on the second end of the arm.

The arm may be constructed as a resilient member connected at the first end to the slider. In particular, it could be formed as an integral part of the slider.

The main body may also include a stop arranged to receive the hook portion when the slider is in the extended position. The stop is preferably arranged in the main body such that, after the latch mechanism unlatches the slider by disengaging the hook portion from the catch and the slider has moved to the extended position, the hook portion is received by the stop and prevents the bias mechanism moving the slider beyond the extended position.

This provides a convenient and space-efficient way of restricting movement of the slider.

Preferably, the end mounting further includes a support shaft extending axially from the recessed end wall so as to define with the main body an axially facing peripheral channel within which the release member may be accessed.

The trigger member of the roller may comprise an axially extending wall at least partly surrounding an axial passageway for receiving the support shaft.

In this way, when the support shaft of the end mounting is inserted into the axial passageway of the roller, the axially extending wall forming the trigger member moves into the axial facing peripheral channel and is able to engage with and move the release member.

Interaction of the support shaft and the axial passageway helps to provide further support for the roller on the end mounting. With the release member provided in the peripheral channel, it is further protected from accidental actuation.

Preferably, the cross-section of the main body is substantially circular so as to act as a bearing for the roller.

In this way, the main body itself forms a rotational support for the roller, with the end opening of the roller having a corresponding cross-section which can rotate around the main body.

Where appropriate, the cross-sections of the support shaft of the main body and the axial passageway of the roller may also be circular.

Preferably, the end mounting is additionally provided with a bracket for attachment to a surround of an architectural opening. The main body may be mounted to or formed integrally with the bracket.

The end mounting may be provided in combination with a roller for a cover of an architectural opening. As will be appreciated from the above, the roller preferably includes a roller end defining an inwardly extending opening having a cross-section corresponding to the cross-section of the main body. The opening is preferably arranged such that the main body can substantially entirely be received within the opening when the slider is in the retracted position and be received up to the slider when the slider is in the extended position.

The invention will be more clearly understood from the following description, given by way of example only, with reference to the accompanying drawings.

DESCRIPTION OF THE PREFERRED EMBODIMENTS

Figure 1:
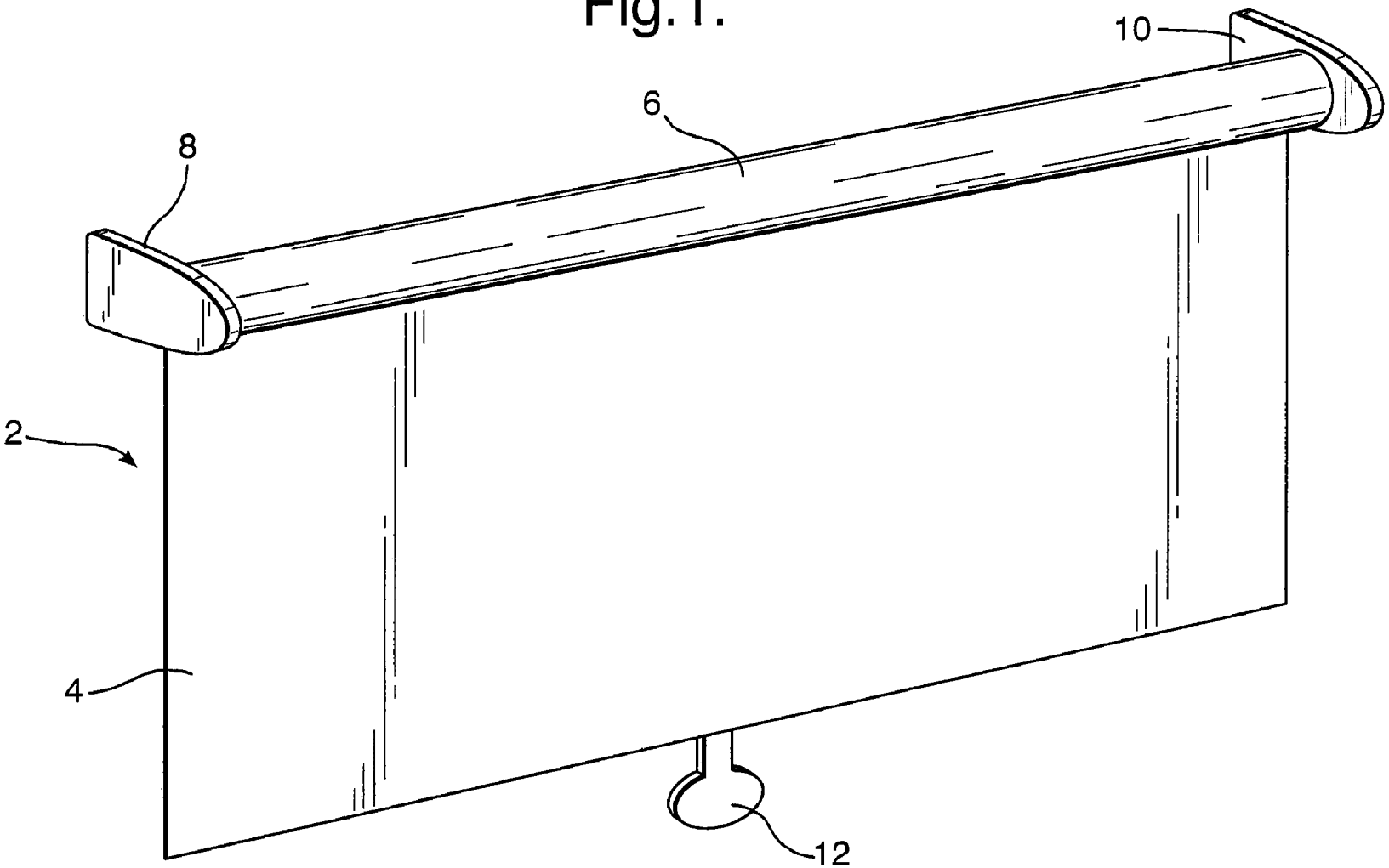
FIG. 1 illustrates a cover and roller in combination with at least one end mounting embodying the present invention.

A variety of blinds are known for covering architectural openings, some of which include a roller from which a covering may be unwound. An example of such a blind 2 is illustrated in FIG. 1 having a covering 4 which, as illustrated, is partly unwound from a roller 6. The roller 6 is mounted between and rotatably supported by two brackets 8 and 10, at least one of which may include an end mounting according to the present invention. As illustrated, the brackets 8, 10 include coverings over their functional components so as to give a more aesthetically pleasing appearance.

A tag 12 may be provided so as to unwind the covering 4 from the roller 6. As illustrated, the roller 6 is orientated horizontally and the covering 4 can be unwound downwardly from the roller 6 so as to cover an architectural opening.

Figure 2A:
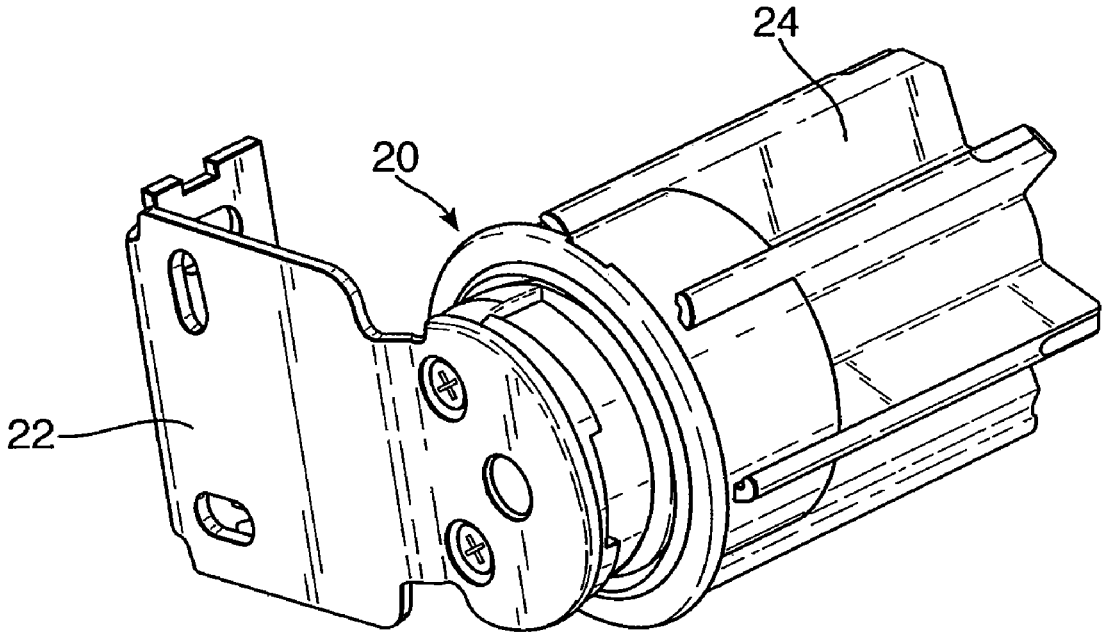
FIGS. 2(*a*) and (*b*) illustrate an end mounting embodying the present invention, together with an end cap for insertion into the end of a roller.
Figure 2B:
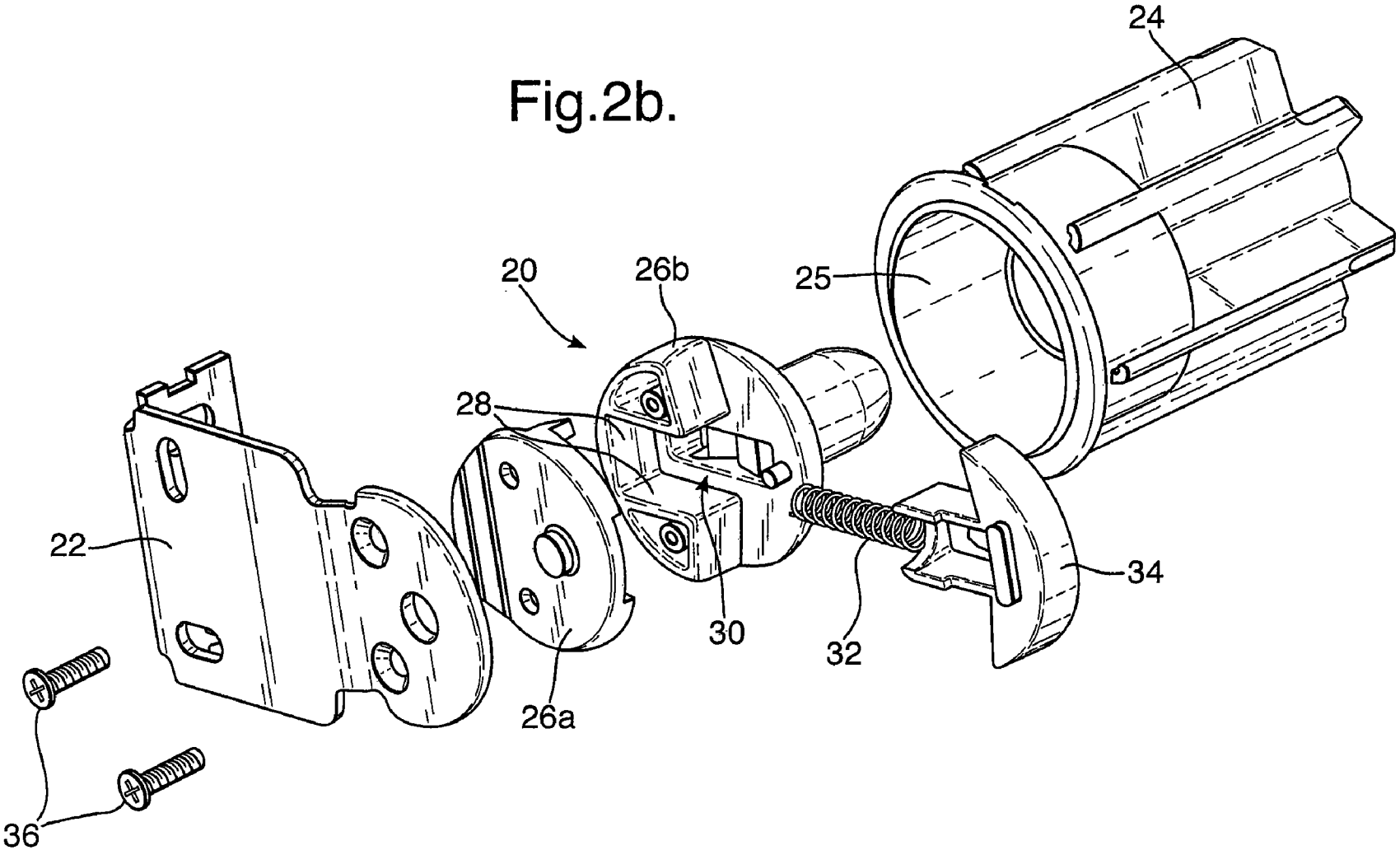

FIGS. 2(*a*) and (*b*) illustrate an end mounting 20 in conjunction with a bracket 22 and an end cap 24 for forming an end of a roller, in this case by insertion into the tubular form of the roller.

The end mounting 20 includes a main body 26 formed, in this embodiment, from two halves 26*a* and 26*b* which include internal walls 28 defining an internal cavity 30.

As part of a bias mechanism, a compression spring 32 is provided within the internal cavity 30. The compression spring 32 acts between one of the walls 28 and a slider 34 which is also received within the internal cavity 30. In particular, as will be described further below, the compression spring 32 acts to bias the slider 34 outwardly with respect to the main body 26.

It is possible for the main body 26 to be formed as a single integral unit or from a number of components which are joined together. In the illustrated embodiment, use is made of screws 36 to attach the first half 26*a* to the second half 26*b* at the same time as attaching the bracket 22 to the main body 26.

In operation, as will be discussed in further detail below, the slider 34 is movable between a retracted and an extended position. In its retracted position, it lies within the cross-section (substantially perpendicular to the axis of the device) of the main body 26. In that way, with the slider 34 in its retracted position as illustrated in FIG. 2(*a*), the main body 26, together with the slider 34, can be inserted fully into the end opening 25 formed in the axial end of the end cap 24. As illustrated, the end opening 25 has a cross-section corresponding to the cross-section of the main body 26.

Figure 5:
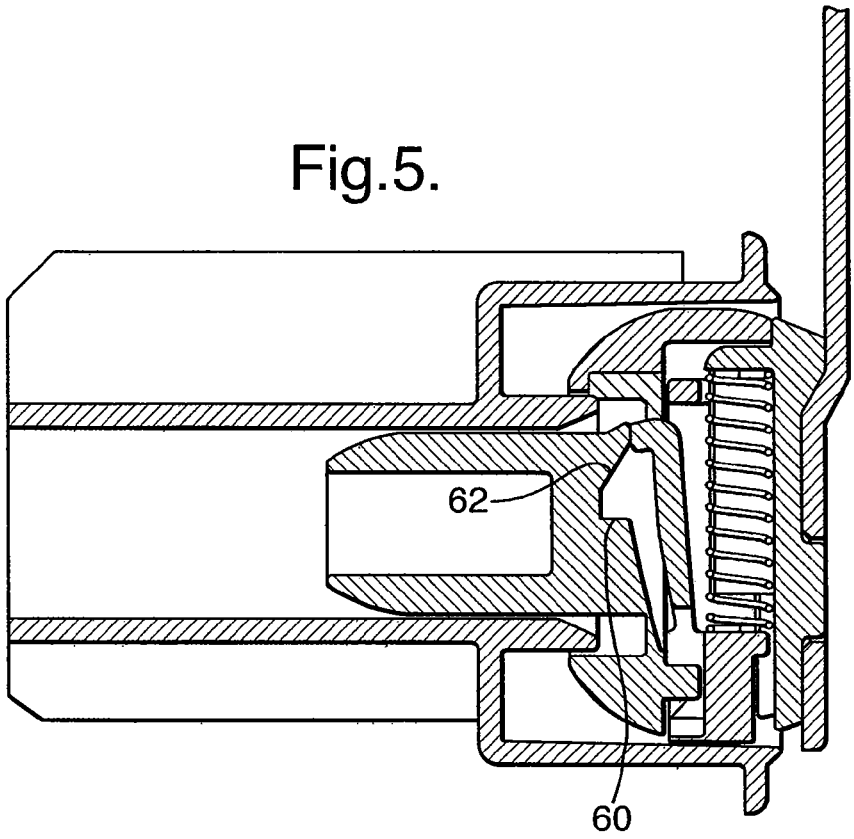
FIG. 5 illustrates the end mounting of FIGS. 2(*a*) and (*b*) in an unlatched state.

With the slider 34 in its extended position, for instance as illustrated schematically in cross-section in FIG. 5, the slider 34 extends outside the cross-section of the main body 26. Hence, in this state, it is not possible to insert the main body 26 into the end opening 25 beyond the slider 34.

In use, with the end cap 24 provided in a roller, the slider 34 is arranged in its retracted position and the roller is moved axially onto the end mounting 20 such that substantially the entire axial extent of the main body 26 is inserted into the end opening 25 of the end cap 24. With the roller so positioned, another end mounting (not necessarily in accordance with the present invention) should already have been provided at a position allowing the other end of the roller to be brought to a position from where it can be axially moved into engagement with that another end mounting. When the roller is so moved away from the end mounting 20 towards the other end mounting, the slider 34 can be moved to its extended position. This will prevent the end cap 24 and hence the roller from moving back to the position in which the main body was substantially fully encompassed in the end opening 25. In this way, the roller is secured in its installed state.

In the preferred and illustrated embodiment, a bias mechanism, for instance using the compression spring 32, biases the slider 34 to its extended position. In this way, when the roller and end cap 24 is slid away from the end mounting 20, in particular away from the bracket 22, as soon as the slider 34 reaches an axial location outside the end opening 25, it moves to its extended position so as retain the roller in place.

Preferably, as will be described below, the end mounting includes a latch mechanism for the slider 34 such that the slider 34 can be latched in its retracted position while the roller is first fitted to the end mounting 20 and the main body 26 is fully inserted in the end opening 25. As will be explained below, this latch mechanism preferably includes features that allow the slider 34 to become unlatched whilst it is within the end opening 25. In this way, it still moves automatically to its extended position when the end cap 24 is withdrawn away from the end mounting 20.

In the illustrated embodiment, the main body 26 has a generally cylindrical form with its central axis being concentric with the axis of the roller. In this way, the outer surface of the main body, in particular at the periphery of its cross-section, may act as a bearing surface for rotatably supporting the end cap 24 and its roller. The distal end of the main body 26, namely the axial end furthest from the bracket 22, may be provided with a rounded or chamfered surface joining the axial end surface to the circular circumferential surface. This may be useful in assisting a user in locating the end opening 25 of the end cap 24 on the end mounting 20 and inserting the main body 26 into the end opening 25.

It will be appreciated that for correct functioning of the invention, the shape of the slider 34 and its direction of travel between the retracted and extended positions are not important. However, in the illustrated embodiment, at least part of the slider 34 is formed in the shape a segment of the cross-section of the main body 26. With the slider 34 in its retracted position, the outer surface of the segment is continuous with the outer surface of the main body 26. In the illustrated embodiment, in the extended position, the segment is moved radially outwardly such that it protrudes beyond the extent of the cross-section of the main body 26. Preferably, the segment is substantially half the cross-section of the main body 26. This results in a relatively large circumferential length for contact with the end of the end cap 24, preventing movement of the end cap 24 towards the proximal end of the main body 26 attached to the bracket 22.

In one embodiment, for instance as illustrated in FIG. 5, the end cap 24 may be provided with a peripheral axially facing ridge 24*a* and the slider 34 provided with a corresponding arcuate groove facing axially away from the proximal end of the main body 26 so as to receive the ridge 24*a*. Where the slider 34 is in the shape of a segment, it will be appreciated that the radius of the arcuate groove 34*a* will be slightly larger than the radius of the outer surface of the slider 34 and the cross-section of the main body 26.

Figure 3A:
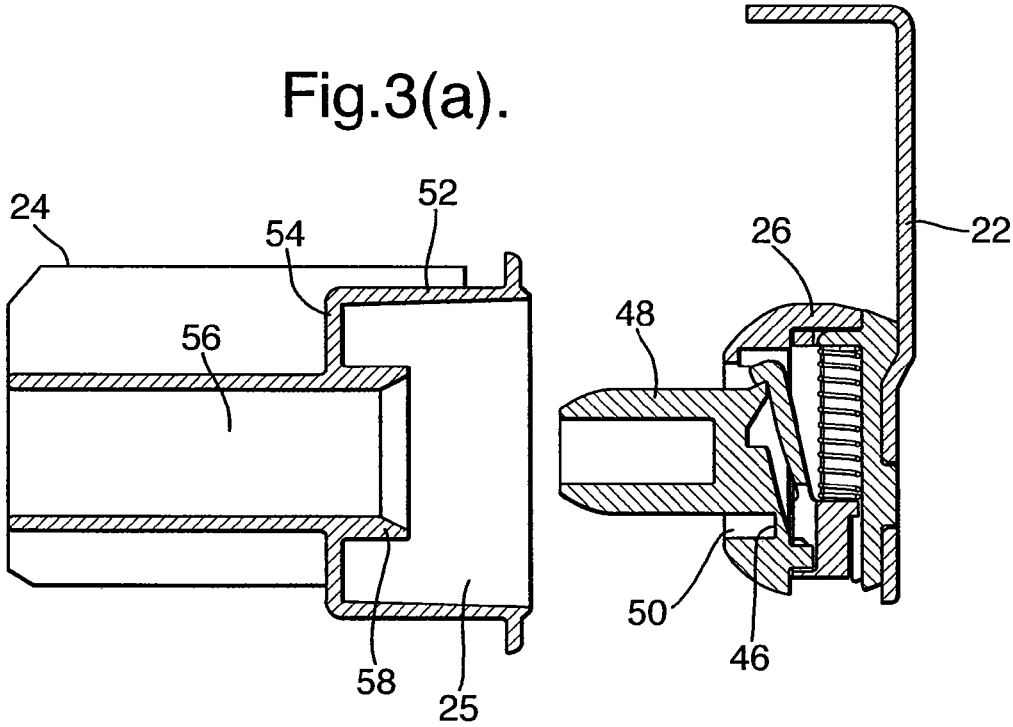
FIGS. 3(*a*) and (*b*) illustrate schematically in cross-section the end mounting of FIGS. 2(*a*) and (*b*) being inserted into the end cap.
Figure 3B:
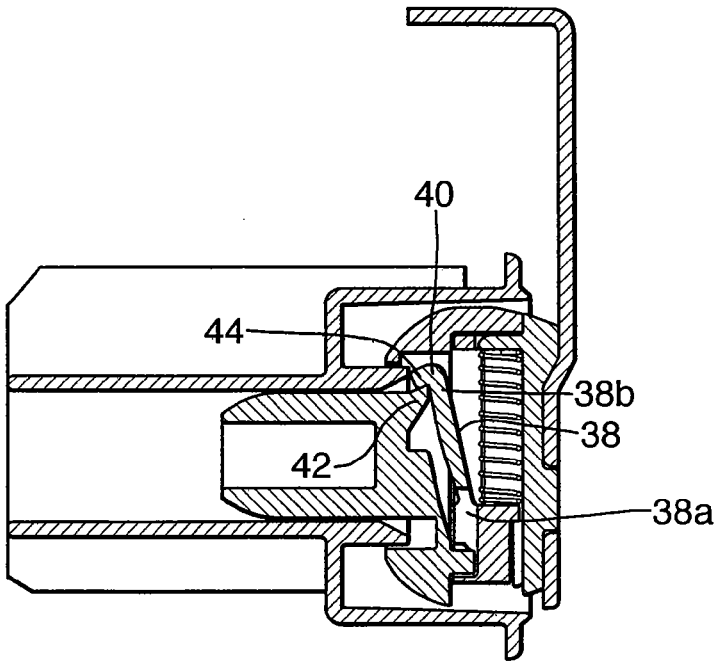

FIGS. 3(*a*) and (*b*) illustrate schematically cross-sections through the end mounting 20, bracket 22 and end cap 24.

As illustrated, the slider 34 is movable in a generally radial direction with respect to the axis of the end mounting 20 and end cap 24. In particular, as illustrated, the slider is movable up and down and is biased by the compression spring 32 in a downward direction. An arm 38 has a first end 38*a* where it meets with the main body of the slider 34 and a second end 38*b* opposite the first end. In the illustrated embodiment, the arm 38 extends in a direction generally parallel with the direction of movement of the slider 34 and the second end 38*b* can be moved in an axial direction towards and away from the proximal end of the main body 26 attached to the bracket 22. In the preferred embodiment, the arm 38 is sufficiently resilient to allow this movement. Preferably, the arm 38 forms an integral part of the slider 34 and is made of the same material, for instance a plastics material.

The second end 38*b* of the arm 38 is provided with a hook portion 40. As illustrated, the walls of the main body 26 are formed with a lip which is adjacent the hook portion 40 when the slider 34 is in its retracted position. The lip forms a catch 42 with which the hook portion 40 co-operates to retain the slider 34 in its retracted position.

Thus, as illustrated in FIG. 3(*b*), while the compression spring 32 provides a force biasing the slider 34 outwardly of the main body 26 towards its extended position, the hook portion 40 engaged with the catch 42 on the main body 26 resists that force and holds the slider 34 in its retracted position.

The second end 38*b* of the arm 38 is also provided with a release member 44. In the illustrated embodiment, this is merely the tip of the hook portion 40. It will be appreciated that by pushing on the release member 44 in an axial direction towards the proximal end of the end mounting 20, the hook portion 40 will become disengaged from the catch 42, thereby allowing the slider 34 to move to its extended position. This will be explained in further detail below.

In the illustrated embodiment, the main body 26 has at its distal end an axially facing recessed end wall 46 from which a support shaft 48 extends axially. The support shaft 48, together with the main body 26, thus define an axially facing peripheral channel 50 with the recessed end wall 46 at its base. An opening is provided in the wall 46 to provide access to the release member 44 formed on the second end 38*b* of the arm 38.

The illustrated end cap 24 for use with the end mounting 20 includes peripheral walls 52 which extend axially to a back wall 54 to define the end opening 25 for receiving the main body 26. Beyond the back wall 54, an axial passageway extends further along the axis of the end cap 24. Where the axial passageway 56 meets the back wall 54 and end opening 25, a trigger member 58 is formed as an axially extending wall around the end of the axial passageway 56, the wall 58 extending axially away from the axial passageway 56. In the preferred embodiment, the trigger member 58 is provided by a wall which completely surrounds the axial passageway 56, because then it has the same functional properties irrespective of the relative rotational orientation of the end cap 24 and end mounting 20.

As illustrated in FIG. 3(*b*), when the main body 26 is inserted into the end opening 25 of the end cap 24, the support shaft 48 extends into the axial passageway 56. This provides additional support for the end cap 24 and its roller. This is particularly advantageous where the end cap 24 is rotationally mounted on the end mounting 20, with the outer surface of the support shaft 48 providing a bearing surface for co-operation with the inner surface of the axial passageway 56.

Figure 4A:
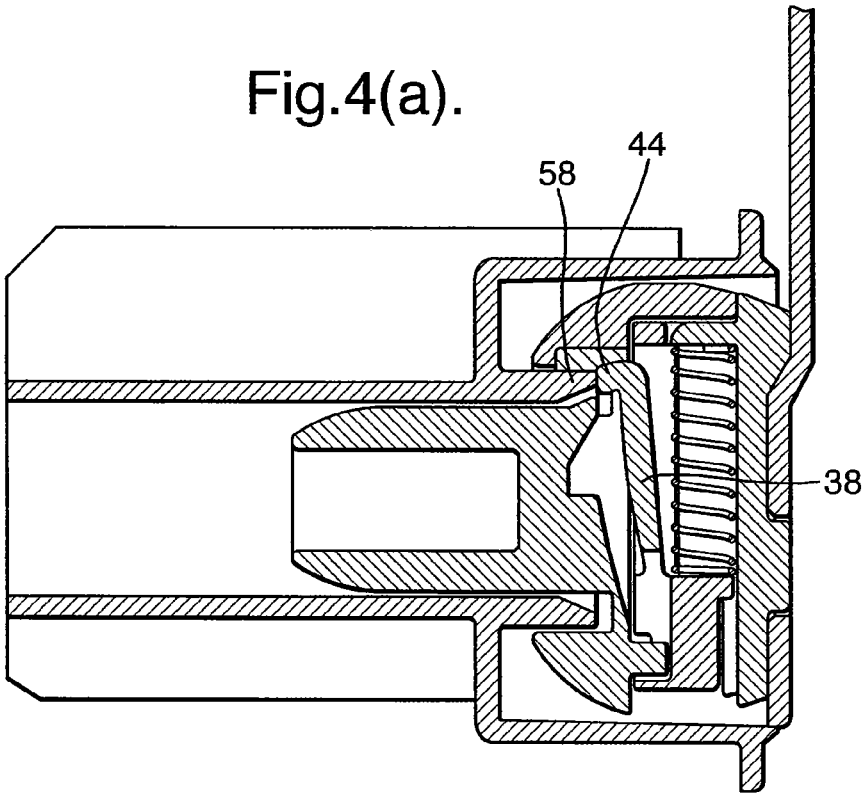
FIGS. 4(*a*) and (*b*) illustrate schematically in cross-section the latching mechanism of the end mounting of FIGS. 2(*a*) and (*b*) being unlatched.
Figure 4B:
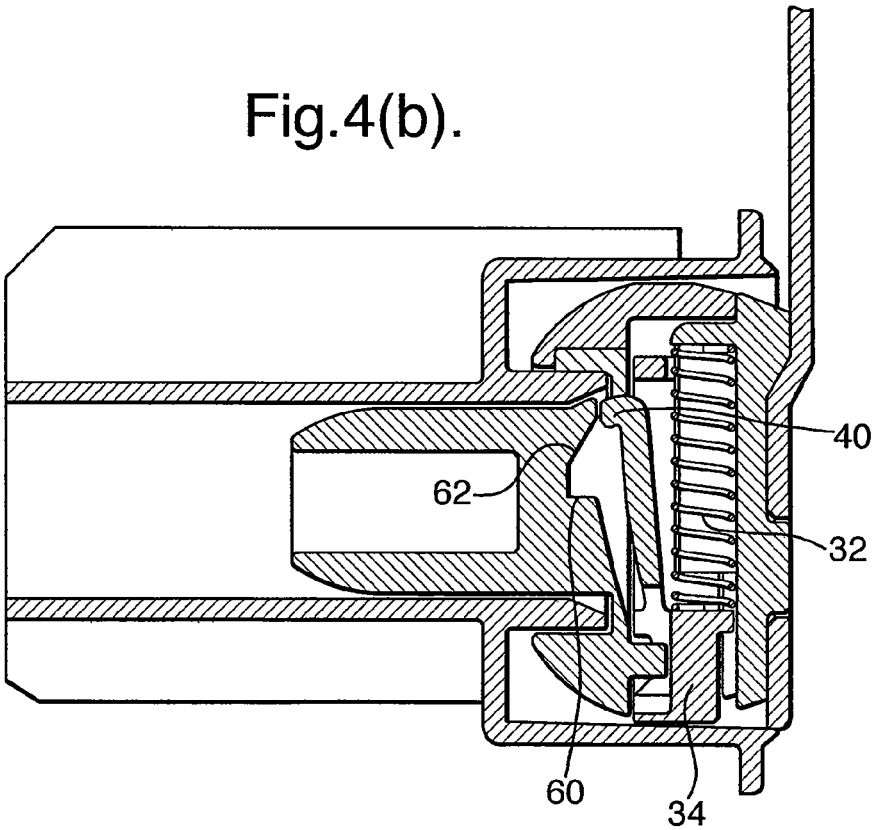

As also illustrated in FIG. 3(*b*), the trigger member 58 formed by the axially extending peripheral wall is dimensioned so as to extend into the peripheral channel 50. In particular, as the main body 26 is progressively inserted into the end opening 25, the axially extending wall 58 first engages with the release member 44 formed on the second end 38*b* of the arm 38 and then moves the release member 44 and hook portion 40 axially away from the catch 42, as illustrated in FIG. 4(*a*).

With the hook portion 40 released from engagement with the catch 42, the slider 34 is free to move under the force of the compression spring 32. This is illustrated in FIG. 4(*b*).

As illustrated, the relative dimensions of the various components are arranged such that the trigger member 58 only unlatches the hook portion 40 from the catch 42 once the slider 34 is within the end opening 25 of the end cap 24. Thus, as illustrated in FIG. 4(*b*), the compression spring 32 moves the slider 34 only as far as is possible before the outer radial surface of the slider 34 engages with the inner surface of the end opening 25. It will be appreciated that the components should be dimensioned such that the slider 34 is able to move by a slight amount such that the hook portion 40 moves beyond the catch 42 and becomes unlatched.

As illustrated in FIG. 5, when the end cap 24 is moved axially away from the end mounting 20 and bracket 22, as long as the slider 34 remains within the end opening 25, the slider 34, the arm 38 and the hook portion 40 all remain in the same position relative to the main body 26.

Figure 6:
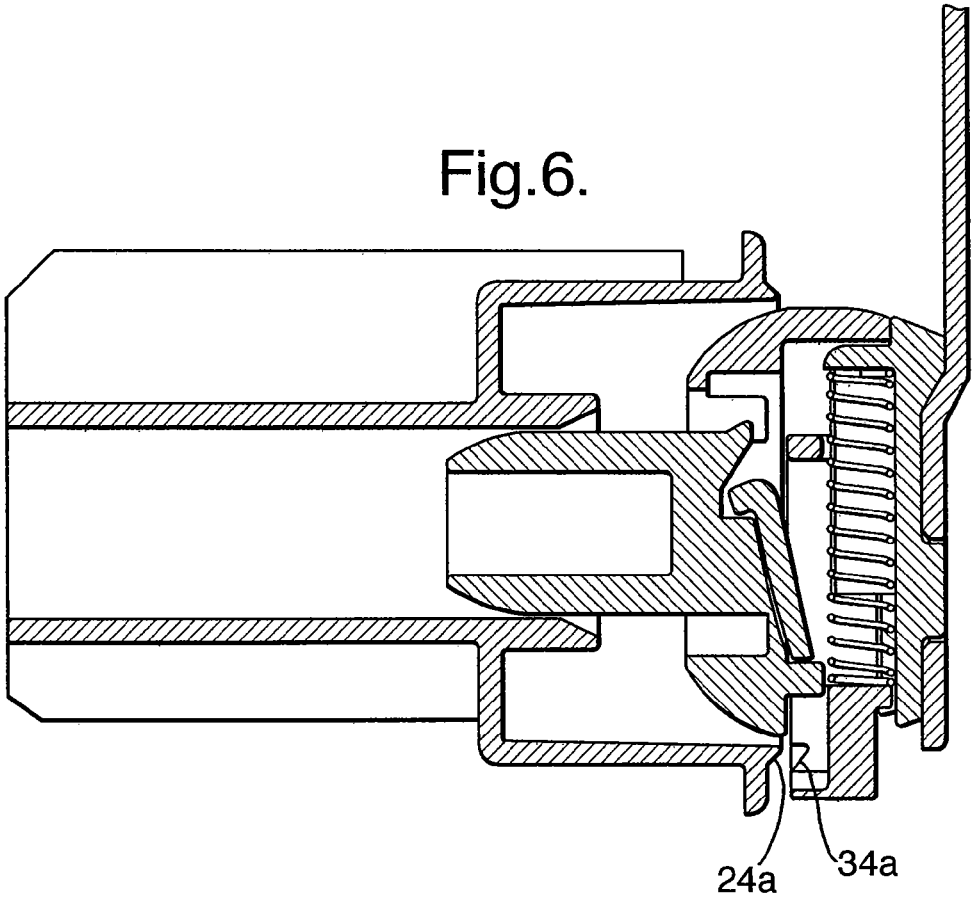
FIG. 6 illustrates the end mounting of FIGS. 2(*a*) and (*b*) with its slider in the extended position.

As illustrated in FIG. 6, as soon as the slider 34 reaches an axial position beyond the end opening 25, there is nothing to hold it in its intermediate position (between the retracted and extended positions) and, hence, the compression spring 32 moves it outwardly to the extended position illustrated in FIG. 6.

FIG. 6 illustrates another feature of the main body 26 which is arranged to secure the slider 34 in its extended position against the continuing force of the compression spring 32. In particular, one of the walls 28 forming the internal cavity 30 is shaped so as to form a stop 60 for receiving the hook portion 40. The arm 38 is resiliently biased away from the proximal end of the main body 26 such that the hook portion 40 is held against the generally axially facing wall 28 between the catch 42 and the stop 60. The stop 60 is formed as a step with a surface orientated generally perpendicular to the direction of movement of the slider 34. The hook portion 40 extends in a generally axial direction and engages with that surface of the stop 60 such that the hook portion 40 and, hence, arm 38 and slider 34 is prevented from further movement. In this way, the slider 34 is surely stopped at a predefined position, namely the extended position.

If a user wishes to uninstall a roller, it is possible to manually push the slider 34 back into the main body 26 from the extended position to the retracted position. In the illustrated embodiment, the wall 28 of the main body 26 between the stop 60 and catch 42 is arranged as a guide surface 62 which progresses gradually towards the proximal end of the main body 26 as it progresses from the stop 60 to the catch 42. In this way, as the slider 34 is moved towards its retracted position and the arm 38 and hook portion 40 are moved in the same direction towards the catch 42, the second end 38*b* of the arm 38 with the hook portion 40 is forced towards the proximal end of the main body 26 until the hook portion 40 has been moved beyond the catch 42. At this time and position, the arm 38 moves the hook portion 40 towards the distal end of the main body 26, such that the hook portion 40 engages with the catch 42 on a side of the catch opposite to the stop 60.

With the end mounting back in its latched and retracted state, the user can slide the end cap 24 and roller towards the bracket 22 so that the main body 26 is once again fully encompassed in the end opening 25 and such that the opposite end of the roller can be uninstalled.

The invention claimed is:

1. An end mounting for supporting the roller of a cover for an architectural opening, the end mounting including:

a main body of substantially constant cross-section extending axially from a proximal end for mounting adjacent an architectural opening to a distal end for insertion into an end opening of a roller; and a slider mounted in the main body at an axial location towards the proximal end of the main body and movable between a retracted position wholly within the cross-section of the main body and an extended position in which at least part of the slider protrudes outside the cross-section of the main body such that, with the slider in the retracted position, substantially all of the main body can be inserted into the end opening of the roller and, with the slider in the extended position, the main body is prevented by the slider from being inserted into the end opening of the roller beyond the slider;

a bias mechanism for biasing the slider from the retracted position to the extended position, said bias mechanism including a compression spring, said main body including walls defining an internal cavity for housing the compression spring and receiving the slider, said compression spring arranged to act between one of the walls and the slider so as to bias the slider from the retracted position to the extended position; and a latch mechanism in the main body for latching the slider in the retracted position against the bias of the bias mechanism.

2. An end mounting according to claim 1 wherein:

the latch mechanism includes a release member movable axially towards the proximal end from a latched position to a released position whereby, with the release member in the released position, the latch mechanism unlatches the slider.

3. An end mounting according to claim 2 wherein:

the main body includes, at the distal end, an axially facing recessed end wall defining an opening through which the release member extends.

4. An end mounting according to claim 2 wherein:

the main body includes a catch; and the latch mechanism includes an arm extending from the slider at a first end to a hook portion at a second end, the hook portion being arranged to engage with the catch so as to latch the slider in the retracted position.

5. An end mounting according to claim 4 wherein:

the second end of the arm and the hook portion are movable relative to the main body so as to disengage the hook portion from the catch and unlatch the slider.

6. An end mounting according to claim 4 wherein:

the release member is provided on the second end of the arm.

7. An end mounting according to claim 4 wherein:

the arm is a resilient member connected at the first end to the slider.

8. An end mounting according to claim 4 wherein:

the main body includes a stop arranged to receive the hook portion when the slider is in the extended position such that, after the latch mechanism unlatches the slider by disengaging the hook portion from the catch and the slider has moved to the extended position, the hook portion is received by the stop and prevents the bias mechanism from moving the slider beyond the extended position.

9. An end mounting according to claim 3 further including:

a support shaft extending axially from the recessed end wall so as to define with the main body an axially facing peripheral channel within which the release member may be accessed.

10. An end mounting according to claim 1 wherein:

the cross-section of the main body is substantially circular so as to act as a bearing for the roller.

11. An end mounting according to claim 1 further including:

a bracket for attachment to a surrounding frame of an architectural opening wherein the main body is mounted to the bracket.

12. The combination of an end mounting and a roller for a covering for an architectural opening, the end mounting including:

a main body of substantially constant cross-section extending axially from a proximal end for mounting adjacent an architectural opening to a distal end for insertion into an end opening of a roller; and a slider mounted in the main body at an axial location towards the proximal end of the main body and movable between a retracted position wholly within the cross-section of the main body and an extended position in which at least part of the slider protrudes outside the cross-section of the main body such that, with the slider in the retracted position, substantially all of the main body can be inserted into the end opening of the roller and, with the slider in the extended position, the main body is prevented by the slider from being inserted into the end opening of the roller beyond the slider;

said roller including a roller end defining an inwardly extending opening having a cross-section corresponding to the cross-section of the main body such that the main body can be received substantially entirely within the opening when the slider is in the retracted position and be received up to the slider when the slider is in the extended position, and further including a bias mechanism in the main body for biasing the slider from the retracted position to the extended position and a latch mechanism for latching the slider in the retracted position against the bias of the bias mechanism, the latch mechanism including a release member movable axially towards the proximal end from a latch position to a release position whereby, when the release member is in the release position, the latch mechanism unlatches the slider, and a trigger member extending in an axial direction from the roller end within said opening and arranged to engage with the release member once the slider is at least partly within said opening such that further movement of the main body into the opening causes the trigger member to move the release member towards the proximal end of the main body and unlatch the slider.

13. A method of securing the roller of an architectural opening covering between two end mountings, the method including:

providing at least one end mounting with a main body of substantially constant cross-section for insertion into an end opening of one end of the roller;

mounting a slider in the main body so as to be movable between a retracted position entirely within the cross-section of the main body and an extended position in which at least part of the slider protrudes outside the cross-section of the main body;

providing a latch in the main body for releasably retaining the slider in the retracted position;

arranging the slider in the retracted position;

positioning the one end of the roller on the at least one end mounting with the main body entirely within the end opening;

fitting the other end of the roller to the other of the two end mountings by moving the roller axially to expose the slider;

releasing the latch; and moving the slider to the extended position such that the main body is prevented by the slider from being inserted into the end opening of the roller beyond the slider so as to maintain the axial position of the roller and maintain the other end of the roller on the other end mounting.

14. An end mounting in combination with a roller according to claim 12 further including:

a support shaft extending axially from the recessed end wall so as to define with the main body an axially facing peripheral channel within which the release member may be accessed; wherein:

the trigger member comprises an axially extending wall at least partly surrounding an axial passageway for receiving the support shaft.

* * * * *